US011724862B2

(12) United States Patent
Azuma et al.

(10) Patent No.: US 11,724,862 B2
(45) Date of Patent: Aug. 15, 2023

(54) CAP AND CONTAINER

(71) Applicant: YOSHINO KOGYOSHO CO., LTD., Tokyo (JP)

(72) Inventors: Kazumi Azuma, Tokyo (JP); Tetsuo Takahashi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 71 days.

(21) Appl. No.: 17/433,981

(22) PCT Filed: Dec. 16, 2019

(86) PCT No.: PCT/JP2019/049233
§ 371 (c)(1),
(2) Date: Aug. 25, 2021

(87) PCT Pub. No.: WO2020/174822
PCT Pub. Date: Sep. 3, 2020

(65) Prior Publication Data

US 2022/0161971 A1 May 26, 2022

(30) Foreign Application Priority Data

Feb. 28, 2019 (JP) ..... 2019-036747

(51) Int. Cl.
*B65D 41/04* (2006.01)
*B65D 51/18* (2006.01)
*B65D 51/24* (2006.01)

(52) U.S. Cl.
CPC ..... *B65D 41/045* (2013.01); *B65D 41/0478* (2013.01); *B65D 41/0492* (2013.01); *B65D 51/185* (2013.01); *B65D 51/24* (2013.01)

(58) Field of Classification Search
CPC ..... B65D 41/045; B65D 41/0478; B65D 41/0492; B65D 51/185; B65D 51/24
(Continued)

(56) References Cited

U.S. PATENT DOCUMENTS 4,271,974 A * 6/1981 Quinard ..... B65D 51/18 215/331
2007/0158298 A1* 7/2007 Canamasas Puigbo ..... B65D 41/0492 215/277

(Continued)

FOREIGN PATENT DOCUMENTS

CN 105612108 A * 5/2016 ..... B65D 41/023
DE 60217400 T2 * 4/2007 ..... A45D 33/18

(Continued)

OTHER PUBLICATIONS

Mar. 10, 2020 International Search Report issued in International Patent Application No. PCT/JP2019/049233.

(Continued)

*Primary Examiner* — J. Gregory Pickett
*Assistant Examiner* — Niki M Eloshway
(74) *Attorney, Agent, or Firm* — Oliff PLC

(57) ABSTRACT

A cap configured to be detachably attached to a mouth portion of a container body having a containment space for contents and close the mouth portion, includes: a transparent or semitransparent topped tubular outer lid portion; and a topped tubular inner lid portion located in close contact with an inner side of the outer lid portion so as to be relatively non-rotatable. A retaining protrusion having an inclined surface that is inclined inward in a downward direction and extends to a lower end of the outer lid portion is provided on an inner peripheral surface of the outer lid portion. The retaining protrusion engages with a retaining depression provided on an outer peripheral surface of the inner lid portion, to suppress separation between the outer lid portion and the inner lid portion.

10 Claims, 7 Drawing Sheets

(58) Field of Classification Search
USPC ..... 215/200
See application file for complete search history.

(56) References Cited

U.S. PATENT DOCUMENTS

| | | | | |
|---|---|---|---|---|
| 2009/0056739 | A1* | 3/2009 | Lou | A45D 33/02<br>132/317 |
| 2021/0153622 | A1* | 5/2021 | Bickford | A45D 34/04 |

FOREIGN PATENT DOCUMENTS

| | | | | | |
|---|---|---|---|---|---|
| EP | 3260390 | A1 | * | 12/2017 | B65D 41/0414 |
| GB | 2053864 | A | * | 2/1981 | B65D 41/0435 |
| GB | 2148859 | A | * | 6/1985 | B65D 41/0435 |
| JP | 2002034645 | A | * | 2/2002 | |
| JP | 2005-170476 | A | | 6/2005 | |
| JP | 2005-335799 | A | | 12/2005 | |
| JP | 2005-342567 | A | | 12/2005 | |
| JP | 2006-137444 | A | | 6/2006 | |
| JP | 2016-69020 | A | | 5/2016 | |
| JP | 2016-124579 | A | | 7/2016 | |

OTHER PUBLICATIONS

Oct. 21, 2022 Extended European Search Report issued in European Patent Application No. 19917162.0.
Aug. 25, 2021 International Preliminary Report on Patentability issued in International Patent Application No. PCT/JP2019/049233.
Jul. 12, 2022 Office Action issued in Chinese Patent Application No. 201980093174.8.
Jun. 14, 2022 Office Action issued in Japanese Patent Application No. 2019-036747.

* cited by examiner

CAP AND CONTAINER

TECHNICAL FIELD

The present disclosure relates to a cap of a laminate structure including a transparent or semitransparent topped (i.e. having a top) tubular outer lid portion and a topped tubular inner lid portion located in close contact with the inner side of the outer lid portion, and a container including the cap.

BACKGROUND

Conventionally known containers for containing contents such as cosmetic cream have a structure including: a bottomed tubular container body that is open upward and has an external thread on its outer periphery: and a cap that is open downward and closes the container body.

For such a container, the following technique is proposed: The cap has a laminate structure (double structure) including an inner lid portion and an outer lid portion, a metal film (metallic luster layer) is provided on the outer surface of the inner lid portion, and the outer lid portion is made of a transparent material (see JP 2005-335799 A (PTL 1)). By allowing the metallic luster layer of the inner lid portion to be seen through the outer lid portion, luxurious appearance can be achieved.

CITATION LIST

Patent Literature

PTL 1: JP 2005-335799 A

SUMMARY

Technical Problem

However, as a result of providing the metallic luster layer on the outer surface of the inner lid portion as in the foregoing cap, the contact (adhesion) strength between the inner lid portion and the outer lid portion decreases. This incurs the risk that the outer lid portion is misaligned with respect to the inner lid portion and lifted off the inner lid portion, or the outer lid portion falls off the inner lid portion due to drop impact or the like. Even in the case where the metallic luster layer is not provided on the outer surface of the inner lid portion, depending on the combination between the material of the inner lid portion and the material of the outer lid portion, the contact strength decreases, and such lifting or falling may occur. In the case where a projection (protrusion) and a groove (depression) for fitting are provided at a noticeable position between the inner lid portion and the outer lid portion in order to prevent such lifting or falling, there is the possibility that the projection and the groove can be seen through the outer lid portion and the appearance design degrades.

It could therefore be helpful to provide a cap and a container that can enhance the contact strength between an inner lid portion and an outer lid portion without degradation in appearance design.

Solution to Problem

A cap according to the present disclosure is a cap configured to be detachably attached to a mouth portion of a container body having a containment space for contents and close the mouth portion, the cap comprising: a topped tubular outer lid portion that is transparent or semitransparent; and a topped tubular inner lid portion located in close contact with an inner side of the outer lid portion so as to be relatively non-rotatable, wherein a retaining protrusion is provided on an inner peripheral surface of the outer lid portion, the retaining protrusion having an inclined surface that is inclined inward in a downward direction and extends to a lower end of the outer lid portion, and the retaining protrusion engages with a retaining depression provided on an outer peripheral surface of the inner lid portion, to suppress separation between the outer lid portion and the inner lid portion.

Preferably, in the cap according to the present disclosure, a metallic luster layer is formed on an outer surface of the inner lid portion.

Preferably, the cap according to the present disclosure comprises a topped tubular attachment portion fixed to and held by an inner side of the inner lid portion, and configured to be attached to the mouth portion of the container body.

Preferably, in the cap according to the present disclosure, an internal thread portion is provided on an inner peripheral surface of the attachment portion, the internal thread portion being configured to engage with an external thread portion provided on an outer peripheral surface of the mouth portion of the container body.

Preferably, in the cap according to the present disclosure, the outer peripheral surface of the inner lid portion has a polygonal shape in a plan view.

Preferably, in the cap according to the present disclosure, a knurling having irregularities repeated in a circumferential direction is provided on the outer peripheral surface of the inner lid portion.

Preferably, in the cap according to the present disclosure, satin-like irregularities are provided on the outer peripheral surface of the inner lid portion.

Preferably, in the cap according to the present disclosure, a depression or a protrusion for suppressing rotation of the inner lid portion relative to the outer lid portion is provided on part of the outer peripheral surface of the inner lid portion in a circumferential direction.

Preferably, in the cap according to the present disclosure, the outer peripheral surface of the inner lid portion has an elliptical shape in a plan view.

Preferably, a container according to the present disclosure comprises: a bottomed tubular container body having a containment space for contents; and the above-described cap attached to a mouth portion of the container body.

Advantageous Effect

It is thus possible to provide a cap and a container that can enhance the contact strength between an inner lid portion and an outer lid portion without degradation in appearance design.

DETAILED DESCRIPTION

One of the disclosed embodiments will be described in detail below, with reference to the drawings. Herein, the upper side is the side on which a cap 20 is located with respect to a container body 10, and the lower side is the opposite side (i.e. the side on which the container body 10 is located with respect to the cap 20).

Figure 1:
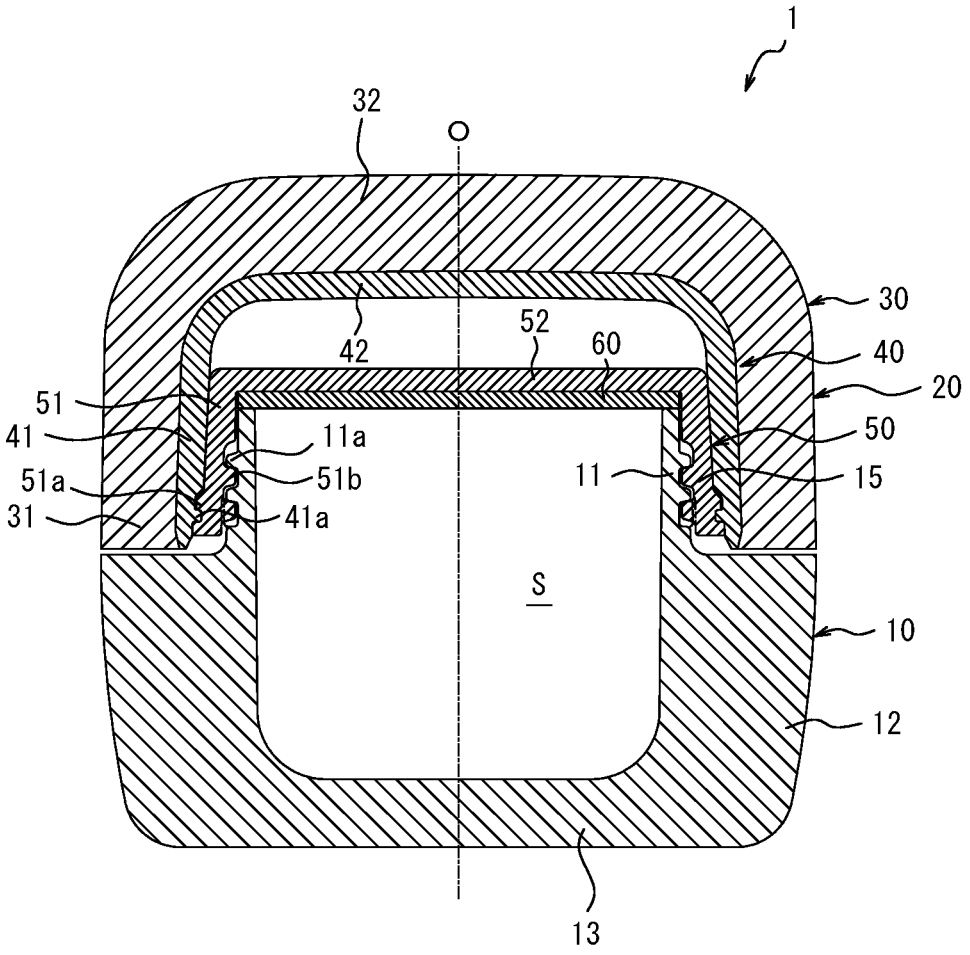
FIG. 1 is a sectional side view of a container according to one of the disclosed embodiments.

As illustrated in FIG. 1, a container 1 according to this embodiment includes the bottomed tubular container body 10 and the topped tubular cap 20 detachably attached to the container body 10. The cap 20 is detachably attached to a mouth portion 11 of the container body 10, and closes the mouth portion 11.

The container body 10 includes the tubular mouth portion 11 having an axis O as a central axis, a barrel portion 12 located below and connected to the mouth portion 11, and a bottom portion 13 closing the lower end of the barrel portion 12. A containment space S for containing contents is formed inside the container body 10. The container body 10 may have a structure in which the contents are directly charged into the containment space S, or a structure in which a bottomed tubular inner container or the like containing the contents beforehand is placed in the containment space S in a replaceable manner.

The cap 20 includes a transparent or semitransparent outer lid portion 30 and a topped tubular inner lid portion 40 located in close contact with the inner side of the outer lid portion 30 so as to be relatively non-rotatable. Although the cap 20 in this example has a triple structure in which an attachment portion 50 is fixed to and held by the inner side of the inner lid portion 40, the present disclosure is not limited to such, and the cap 20 may have a double structure composed only of the outer lid portion 30 and the inner lid portion 40, or a quadruple or higher laminate structure. The material of each of the outer lid portion 30, the inner lid portion 40, and the attachment portion 50 is not limited, and may be a synthetic resin.

The outer lid portion 30 may be partially non-transparent as long as it is transparent or semitransparent as a whole. For example, the outer lid portion 30 may be made of a highly transparent resin such as polyester resin (PETG, PCTA, PCTG, PCT, etc.), SAN (styrene acrylonitrile copolymer), PMMA (methyl polyacrylate), or ionomer. The inner lid portion 40 may be made of a non-transparent material, or may be transparent or semitransparent. For example, the inner lid portion 40 may be made of a resin having relatively high heat resistance such as PC (polycarbonate).

The outer lid portion 30 has a tubular (cylindrical in this example) outer peripheral wall 31 and an outer top wall 32 connected to the upper end of the outer peripheral wall 31.

Figure 2:
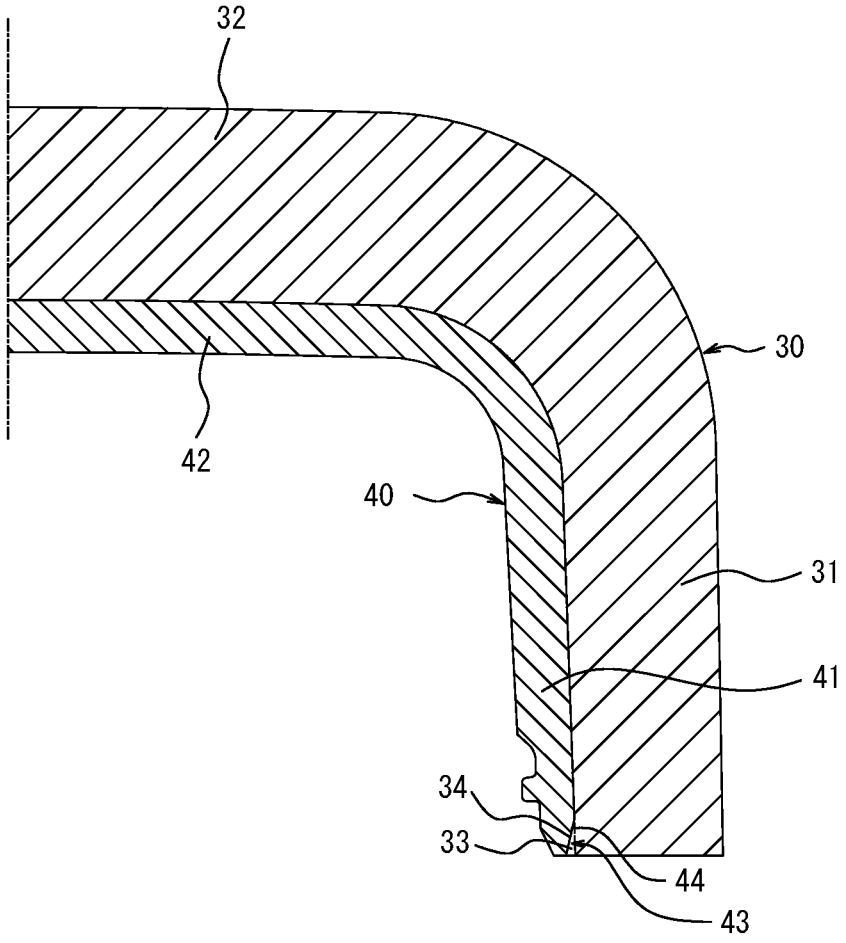
FIG. 2 is a partially enlarged sectional view of an outer lid portion and an inner lid portion in the container in FIG. 1.

FIG. 2 is a partially enlarged sectional view of the outer lid portion 30 and the inner lid portion 40 in the cap 20 in FIG. 1. As illustrated in FIG. 2, a retaining protrusion 33 is provided at the lower end of the inner peripheral surface of the outer peripheral wall 31 in the outer lid portion 30. The retaining protrusion 33 has an inclined surface 34 that is inclined inward (i.e. toward the axis O) in the downward direction and extends to the lower end of the outer lid portion 30 (the lower end of the outer peripheral wall 31). The inclined surface 34 is not limited to a flat surface as in this example, and may be a curved surface. The upper end of the flat surface is preferably connected smoothly to the inner peripheral surface of the outer peripheral wall 31. The retaining protrusion 33 may be provided on the whole of the outer peripheral wall 31 in the circumferential direction, or provided on only part of the outer peripheral wall 31 in the circumferential direction. In this example, the retaining protrusion 33 is provided on only part of the outer peripheral wall 31 in the circumferential direction, and the retaining protrusion 33 and the below-described retaining depression 43 also function as a rotation suppression portion that suppresses the rotation of the outer lid portion 30 relative to the inner lid portion 40.

The inner lid portion 40 has a tubular (cylindrical in this example) inner peripheral wall 41 and a top wall 42 connected to the upper end of the inner peripheral wall 41. The retaining depression of the shape corresponding to the retaining protrusion 33 is formed on the outer peripheral surface of the inner peripheral wall 41 in the inner lid portion 40. The retaining depression 43 has an inclined surface 44 that is inclined inward (i.e. toward the axis O) in the downward direction and extends to the lower end of the inner lid portion 40 (the lower end of the inner peripheral wall 41). The shape of the retaining depression 43 matches the shape of the retaining protrusion 33, and the inclined surface 44 is in close contact with the inclined surface 34 of the retaining protrusion 33.

The retaining protrusion 33 and the retaining depression 43 function as a separation suppression portion that suppresses separation between the outer lid portion 30 and the inner lid portion 40. In detail, the retaining protrusion 33 of the outer lid portion 30 is fitted into and undercut-engages with the retaining depression 43 of the inner lid portion 40, thus suppressing separation between the outer lid portion 30 and the inner lid portion 40 in the axial direction (i.e. the direction along the axis O). By providing such a separation suppression portion, the outer lid portion 30 can be prevented from lifting or falling off the inner lid portion 40.

The attachment portion 50 has a tubular (cylindrical in this example) attachment peripheral wall 51 and a closure wall 52 connected to the upper end of the attachment peripheral wall 51. Although a space is formed between the closure wall 52 and the top wall 42 of the inner lid portion 40 in this example, the present disclosure is not limited to such, and the closure wall 52 and the top wall 42 may be in close contact with each other.

An engaging protrusion 51*a* is provided on the outer peripheral surface of the attachment peripheral wall 51. As a result of the engaging protrusion 51*a* engaging with an engaged protrusion 41*a* provided on the inner peripheral surface of the inner peripheral wall 41 in the inner lid portion 40, the attachment portion 50 is engaged with and held by the inner side of the inner lid portion 40.

An internal thread portion 51*b* is provided on the inner peripheral surface of the attachment peripheral wall 51. An external thread portion 11*a* is provided on the outer peripheral surface of the mouth portion 11 in the container body 10. As a result of the internal thread portion 51*b* engaging with the external thread portion 11*a*, the cap 20 is detachably attached to the container body 10.

A disk-shaped packing 60 is provided on the lower surface of the closure wall 52. By sandwiching the packing 60 between the lower surface of the closure wall 52 and the upper end surface of the mouth portion 11 as illustrated in FIG. 1, the sealing property of the cap 20 that closes the mouth portion 11 can be enhanced.

As described above, the container 1 and the cap 20 according to this embodiment include the retaining protrusion 33 and the retaining depression 43 as the separation suppression portion, so that the outer lid portion 30 can be prevented from lifting of falling off the inner lid portion 40. Moreover, since the retaining protrusion 33 has the inclined surface 34 that is inclined inward in the downward direction and extends to the lower end of the outer lid portion 30, even if the retaining protrusion 33 and the retaining depression 43 can be seen through the outer lid portion 30, the retaining protrusion 33 and the retaining depression 43 are unnoticeable. Hence, degradation in appearance design can be prevented.

Particularly in the case of performing insert molding (overmolding) whereby, using the primary-molded inner lid portion 40 as an insert material, the outer lid portion 30 is secondary-molded with a resin different form the inner lid portion 40, because of no compatibility (or low compatibility) between the resin forming the inner lid portion 40 and the resin forming the outer lid portion 30, there is the possibility of poor appearance as a result of the inner lid portion 40 and the outer lid portion 30 being not in close contact with each other. In this embodiment, by providing the retaining protrusion 33 and the retaining depression 43 as the separation suppression portion, the contact strength can be enhanced even in the case where the resin forming the inner lid portion 40 and the resin forming the outer lid portion 30 are not compatible with each other, with it being possible to improve the appearance.

For example, consider the case of enhancing the contact strength between an outer lid portion and an inner lid portion whose outer surface is subjected to aluminum vapor deposition and then coated with an acrylic resin to form a metallic luster layer, without providing the retaining protrusion 33 and the retaining depression 43 as the separation suppression portion. For this attempt, a method of enhancing the contact strength by surface-treating (e.g. frame-treating) the metallic luster layer on the outer surface of the inner lid portion before the insert molding of molding the outer lid portion using the inner lid portion as the insert material may be used. However, in the case where the metallic luster layer on the outer surface of the inner lid portion is surface-treated, the inner lid portion may deform improperly due to heat. The container 1 and the cap 20 according to this embodiment, on the other hand, include the retaining protrusion 33 and the retaining depression 43 as the separation suppression portion, so that the outer lid portion 30 can be prevented from lifting or falling off the inner lid portion 40 without performing the foregoing surface treatment. Since there is no possibility of improper deformation caused by surface treatment, appearance deterioration can be prevented.

Thus, the container 1 and the cap 20 according to this embodiment can enhance the contact strength between the inner lid portion 40 and the outer lid portion 30 without degradation in appearance design.

The rotation suppression portion for suppressing relative rotation about the axis O is provided between the outer lid portion 30 and the inner lid portion 40. By providing the rotation suppression portion, a misalignment between the outer lid portion 30 and the inner lid portion 40 in the circumferential direction is also suppressed (i.e. the outer lid portion 30 and the inner lid portion 40 are relatively non-rotatable). Thus, separation between the outer lid portion 30 and the inner lid portion 40 can be suppressed more reliably. In this example, the retaining protrusion 33 and the retaining depression 43 are provided only on part of the circumference, and engage with each other in the circumferential direction, too. Hence, the retaining protrusion 33 and the retaining depression 43 function as the rotation suppression portion for suppressing the rotation of the outer lid portion 30 relative to the inner lid portion 40.

The rotation suppression portion is not limited to this example. For example, any of the structures illustrated in FIGS. 3A and 3B, 4A and 4B, 5A and 5B, 6A and 6B, and 7A and 7B may be employed.

Figure 3A:
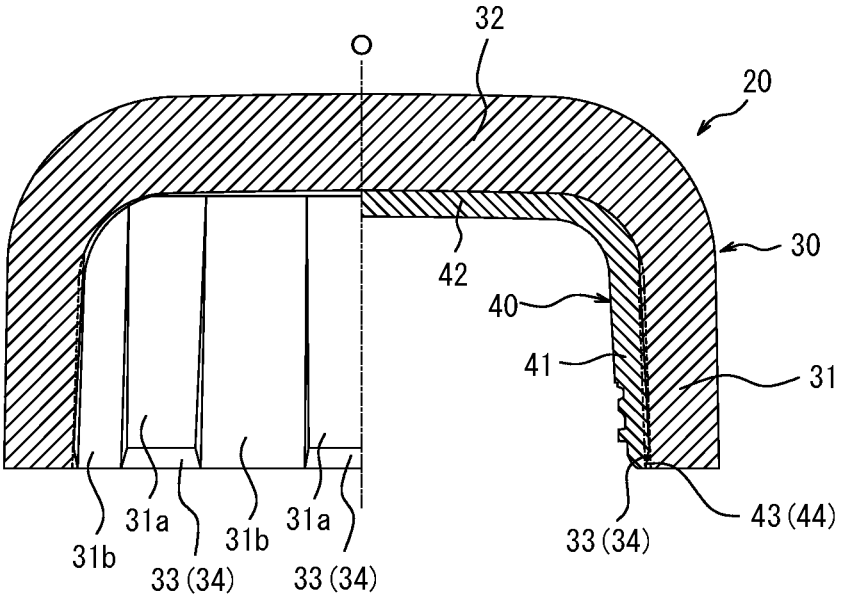
FIG. 3A is a sectional side view of a modification of a rotation suppression portion in the container in FIG. 1.
Figure 3B:
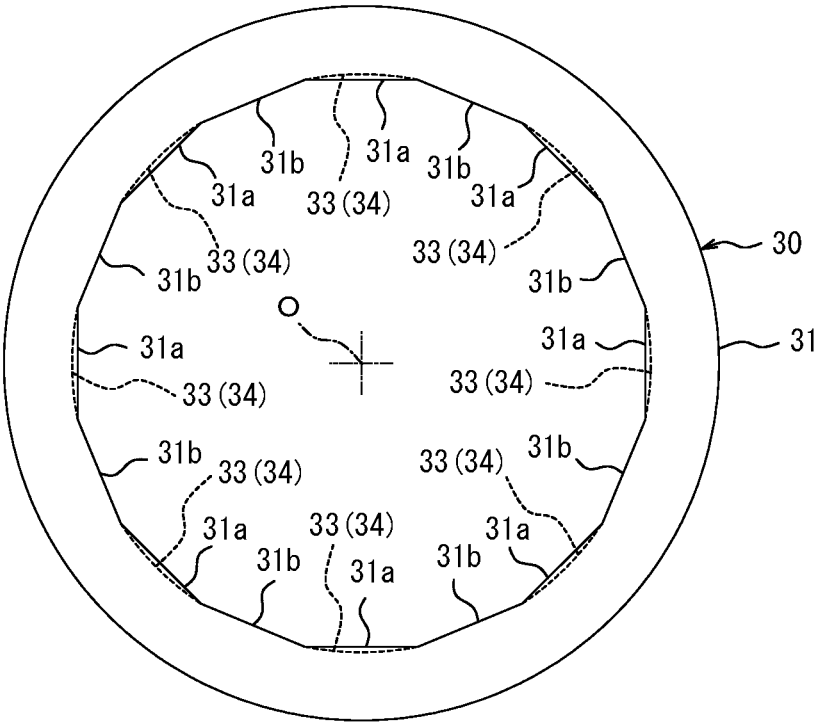
FIG. 3B is a bottom view of the modification of the rotation suppression portion in the container in FIG. 1.

In the example illustrated in FIGS. 3A and 3B, the outer peripheral surface of the inner lid portion 40 has a polygonal shape in a plan view. The right half part of the sectional view in FIG. 3A illustrates the outer lid portion 30 and the inner lid portion 40 in the cap 20. The left half part of the sectional view in FIG. 3A and the bottom view in FIG. 3B illustrate only the outer lid portion 30 while omitting the inner lid portion 40.

In this example, the outer peripheral surface of the inner peripheral wall 41 in the inner lid portion 40 is a regular hexadecagon in a plan view, and correspondingly the inner peripheral surface of the outer peripheral wall 31 in the outer lid portion 30 is a regular hexadecagon in a plan view, too. The outer peripheral surface of the inner lid portion 40 and the inner peripheral surface of the outer lid portion 30 that are polygonal in a plan view engage with each other in the circumferential direction, and therefore function as the rotation suppression portion. In the example illustrated in FIGS. 3A and 3B, of the 16 surfaces (sides) formed in the inner peripheral surface of the outer peripheral wall 31 (i.e. the 16 surfaces (sides) constituting the regular hexadecagon), a surface 31*a* with the retaining protrusion 33 and a surface 31*b* (flat surface) without the retaining protrusion 33 alternate with each other.

Figure 4A:
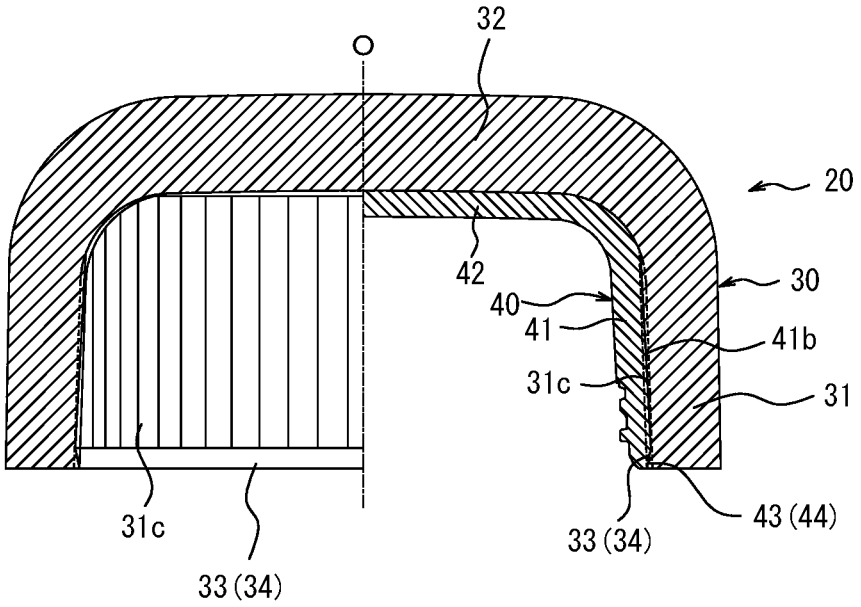
FIG. 4A is a sectional side view of a modification of the rotation suppression portion in the container in FIG. 1.
Figure 4B:
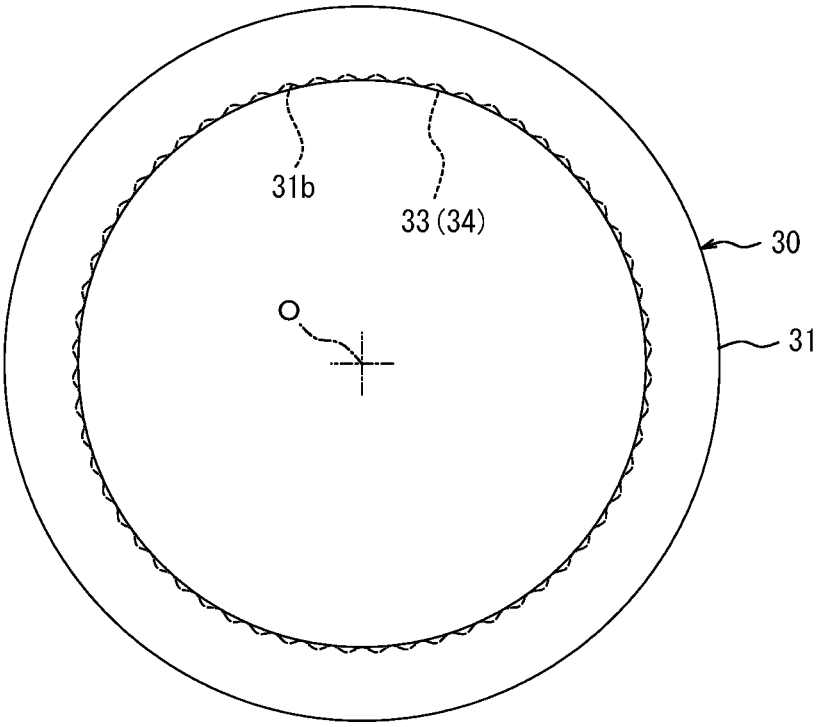
FIG. 4B is a bottom view of the modification of the rotation suppression portion in the container in FIG. 1.

In the example illustrated in FIGS. 4A and 4B, a knurling 41*b* having irregularities repeated in the circumferential direction is provided on the outer peripheral surface of the inner peripheral wall 41 in the inner lid portion 40, and a knurling 31*c* is provided on the corresponding inner peripheral surface of the outer peripheral wall 31 in the outer lid portion 30. The knurling 41*b* of the inner lid portion 40 and the knurling 31*c* of the outer lid portion 30 engage with each other in the circumferential direction, and thus function as the rotation suppression portion. In this example, the retaining protrusion 33 of the outer lid portion 30 and the retaining depression 43 of the inner lid portion 40 are provided on the whole circumference.

Figure 5A:
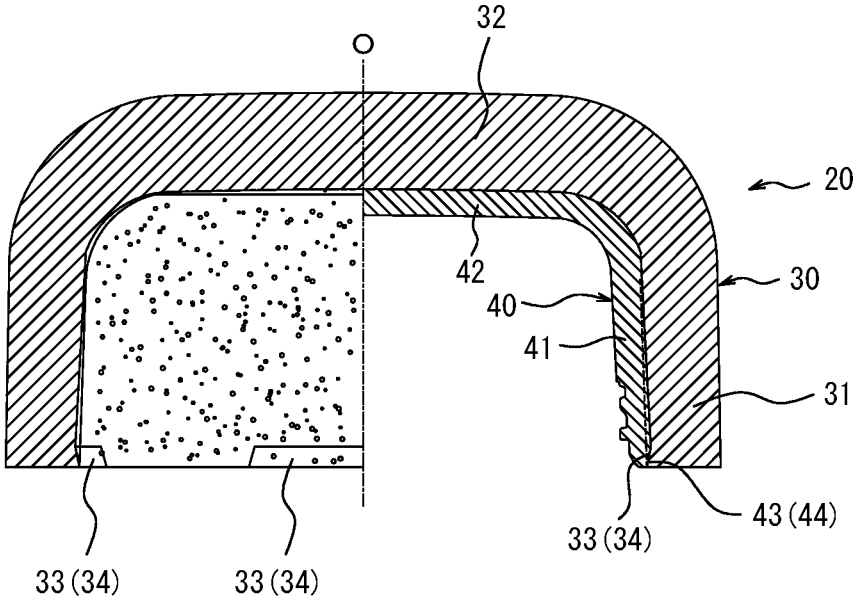
FIG. 5A is a sectional side view of a modification of the rotation suppression portion in the container in FIG. 1.
Figure 5B:
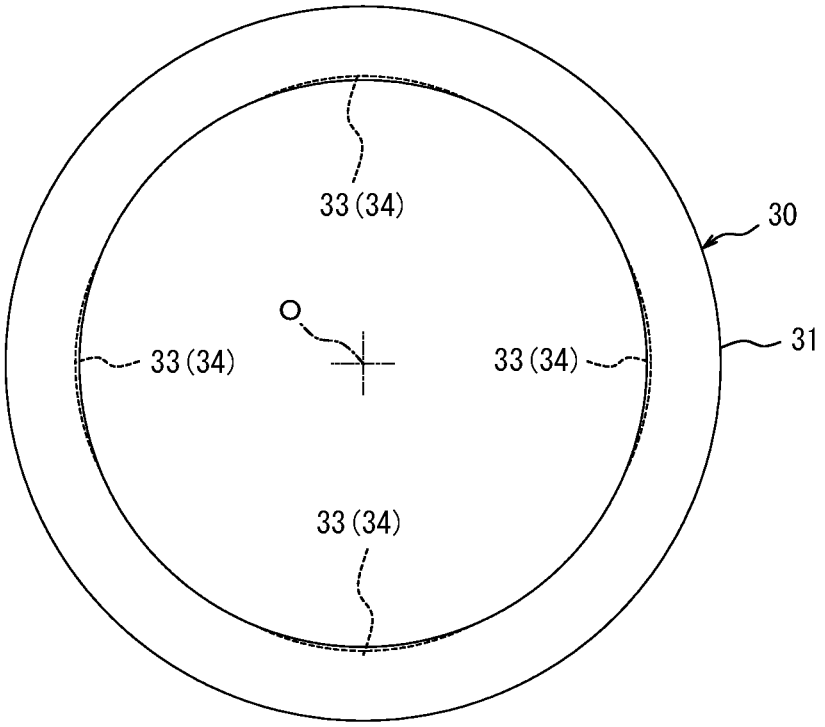
FIG. 5B is a bottom view of the modification of the rotation suppression portion in the container in FIG. 1.

In the example illustrated in FIGS. 5A and 5B, satin-like irregularities (texture) are provided on the outer peripheral surface of the inner peripheral wall 41 in the inner lid portion 40, and also satin-like irregularities are provided on the corresponding inner peripheral surface of the outer peripheral wall 31 in the outer lid portion 30. The satin-like irregularities of the inner lid portion 40 and the satin-like irregularities of the outer lid portion 30 engage with each other in the circumferential direction, and thus function as the rotation suppression portion. In this example, the retaining protrusion 33 of the outer lid portion 30 and the retaining depression 43 of the inner lid portion 40 are provided on part of the circumference. In detail, the retaining protrusion 33 and the retaining depression 43 are located in four positions at equal spacings in the circumferential direction. In this example, the satin-like irregularities are provided on the whole outer surface of the inner lid portion 40 and the whole inner surface of the outer lid portion 30.

Figure 6A:
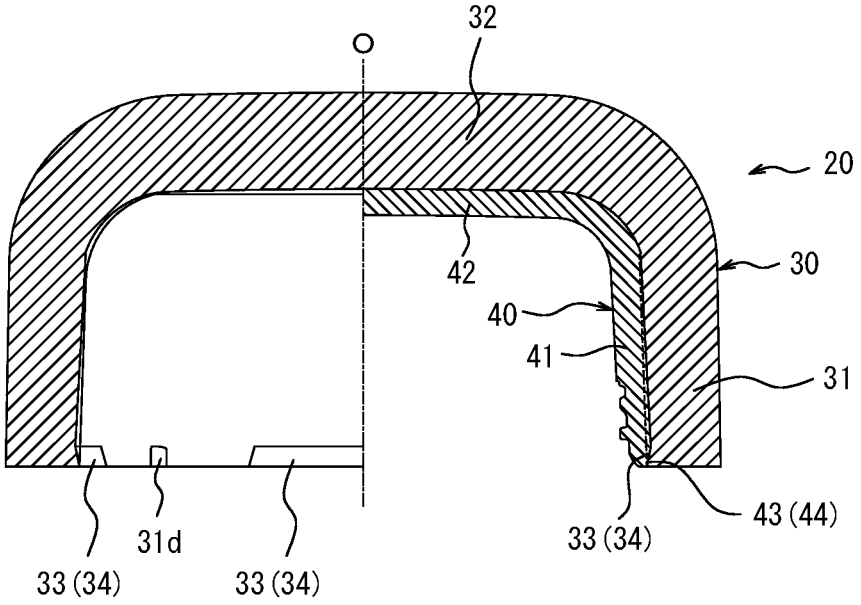
FIG. 6A is a sectional side view of a modification of the rotation suppression portion in the container in FIG. 1.
Figure 6B:
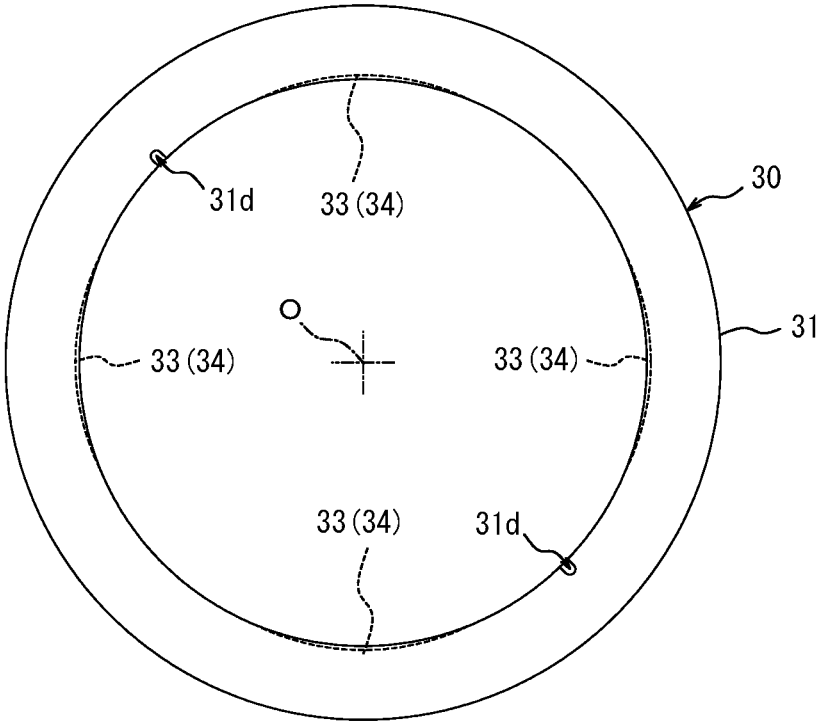
FIG. 6B is a bottom view of the modification of the rotation suppression portion in the container in FIG. 1.

In the example illustrated in FIGS. 6A and 6B, a protrusion projecting radially outward is provided on part of the outer peripheral surface of the inner peripheral wall 41 in the inner lid portion 40 in the circumferential direction, and a depression 31*d* is provided on the corresponding inner peripheral surface of the outer peripheral wall 31 in the outer lid portion 30. The protrusion of the inner lid portion 40 and the depression 31*d* of the outer lid portion 30 engage with each other in the circumferential direction, and thus function as the rotation suppression portion. The protrusion in this example is provided at the lower end of the inner peripheral wall 41, in two circumferential positions opposite to each other with the axis O therebetween. However, the number of protrusions and the positions of the protrusions may be changed as appropriate. The depression and the protrusion may be provided respectively on the outer peripheral surface of the inner peripheral wall 41 and the inner peripheral surface of the outer peripheral wall 31. In this example, the retaining protrusion 33 of the outer lid portion 30 and the retaining depression 43 of the inner lid portion 40 are provided on part of the circumference. In detail, the retaining protrusion 33 and the retaining depression 43 are located in four circumferential positions at equal spacings that are different from the circumferential positions of the depression 31*d* and the protrusion forming the rotation suppression portion.

Figure 7A:
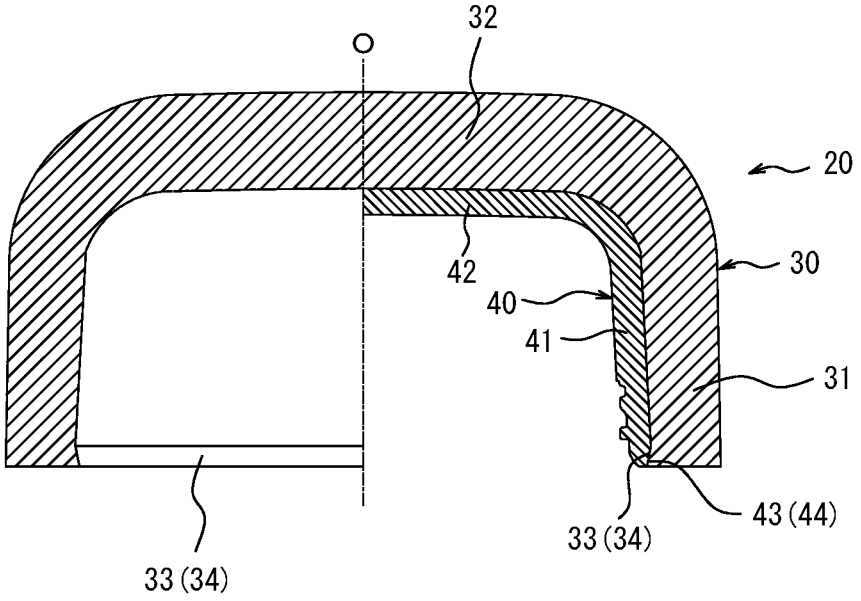
FIG. 7A is a sectional side view of a modification of the rotation suppression portion in the container in FIG. 1.
Figure 7B:
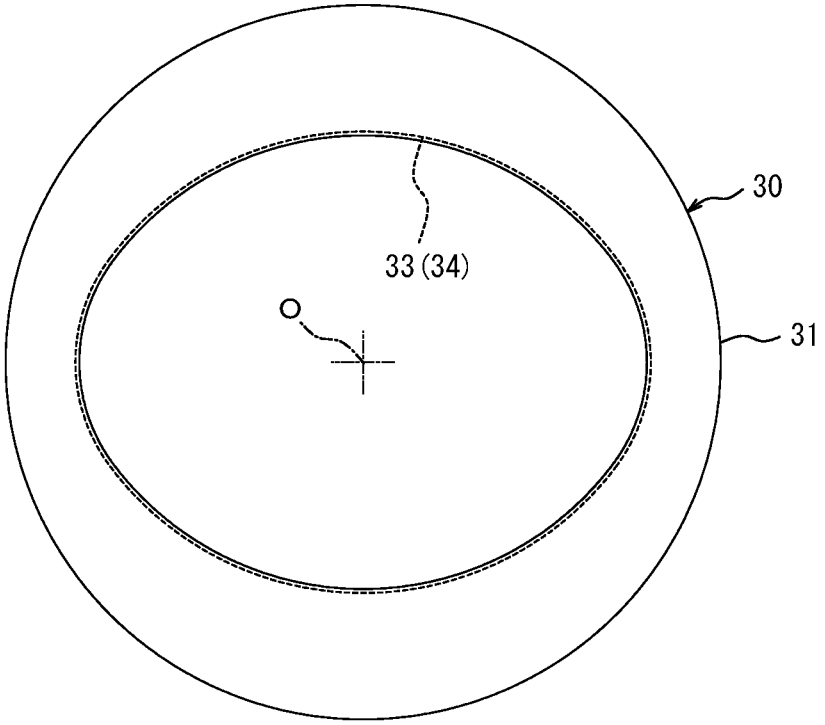
FIG. 7B is a bottom view of the modification of the rotation suppression portion in the container in FIG. 1.

In the example illustrated in FIGS. 7A and 7B, the outer peripheral surface of the inner peripheral wall 41 in the inner lid portion 40 has an elliptical shape in a plan view, and correspondingly the inner peripheral surface of the outer peripheral wall 31 in the outer lid portion 30 has an elliptical shape in a plan view, too. The outer peripheral surface of the inner lid portion 40 and the inner peripheral surface of the outer lid portion 30 elliptically shaped in a plan view engage with each other in the circumferential direction, and thus function as the rotation suppression portion. In this example, the retaining protrusion 33 of the outer lid portion 30 and the retaining depression 43 of the inner lid portion 40 are provided on the whole circumference.

For example, the cap 20 can be formed as follows: The inner lid portion 40 molded by injection molding or the like beforehand is placed in a mold as an insert member, and the outer lid portion 30 is integrally molded (insert-molded) on the outer side of the inner lid portion 40 by injection molding or the like in a state of being in close contact. After this, the attachment portion 50 molded by injection molding or the like separately from the outer lid portion 30 and the inner lid portion 40 is attached to the inner side of the inner lid portion 40. The method of forming the cap 20 is, however, not limited to such. In this case, before molding the outer lid portion 30 on the outer side of the inner lid portion 40, a metallic luster layer may be optionally provided on the outer surface of the inner lid portion 40. The metallic luster layer may be provided, for example, by a hot stamping method or a vacuum vapor deposition method. The metallic luster layer provided on the outer surface of the inner lid portion 40 can be seen through the outer lid portion 30. This further enhances the luxurious appearance of the cap 20. In the case where the metallic luster layer is provided on the outer surface of the inner lid portion 40, the contact strength between the outer lid portion 30 and the inner lid portion 40 decreases. In this embodiment, however, the separation suppression portion (the retaining protrusion 33 and the retaining depression 43) can suppress separation between the outer lid portion 30 and the inner lid portion 40.

Although the presently disclosed technique has been described above based on the illustrated examples, the present disclosure is not limited to the foregoing embodiments, and changes can be made as appropriate within the scope of the claims, For example, the means of engagement between the mouth portion 11 of the container body 10 and the cap 20 is not limited to screw engagement, and an outward protrusion provided on the outer peripheral surface of the mouth portion 11 and an inward protrusion provided on the inner peripheral surface of the cap 20 may detachably undercut-engage with each other.

REFERENCE SIGNS LIST

1 container
10 container body
11 mouth portion
11*a* external thread portion
12 barrel portion
13 bottom portion
20 cap
30 outer lid portion
31 outer peripheral wall
32 top wall
33 retaining protrusion
34 inclined surface
40 inner lid portion
41 inner peripheral wall
41*a* engaged protrusion
42 top wall
43 retaining depression
44 inclined surface
50 attachment portion
51 attachment peripheral wall
51*a* engaging protrusion
51*b* internal thread portion
52 closure wall
60 packing
O axis
S containment space

The invention claimed is:

1. A cap configured to be detachably attached to a mouth portion of a container body having a containment space for contents and close the mouth portion, the cap comprising:

a topped tubular outer lid portion that is transparent or semitransparent;

a topped tubular inner lid portion in close contact with an inner side of the outer lid portion so as to be relatively non-rotatable;

a retaining protrusion on an inner peripheral surface of a lower end of the outer lid portion; and a retaining depression on an outer peripheral surface of a lower end of the inner lid portion, wherein the retaining protrusion has a first inclined surface that is inclined inward in a downward direction and extends to a lower end of the outer lid portion, the retaining depression has a second surface that is inclined inward in the downward direction and extends to a lower end of the inner lid portion, the second inclined surface is in close contact with the first inclined surface, and the retaining protrusion engages with the retaining depression to suppress separation between the outer lid portion and the inner lid portion.

2. The cap according to claim 1, comprising a metallic luster layer on an outer surface of the inner lid portion.

3. The cap according to claim 1, comprising a topped tubular attachment portion fixed to and held by an inner side of the inner lid portion, and configured to be attached to the mouth portion of the container body.

4. The cap according to claim 3, wherein an internal thread portion is on an inner peripheral surface of the attachment portion, and the internal thread portion is configured to engage with an external thread portion on an outer peripheral surface of the mouth portion of the container body.

5. The cap according to claim 1, wherein the outer peripheral surface of the inner lid portion has a polygonal shape in a plan view.

6. The cap according to claim 1, comprising a knurling having irregularities repeated in a circumferential direction on the outer peripheral surface of the inner lid portion.

7. The cap according to claim 1, comprising satin-like irregularities on the outer peripheral surface of the inner lid portion.

8. The cap according to claim 1, comprising a depression or a protrusion for suppressing rotation of the inner lid portion relative to the outer lid portion on part of the outer peripheral surface of the inner lid portion in a circumferential direction.

9. The cap according to claim 1, wherein the outer peripheral surface of the inner lid portion has an elliptical shape in a plan view.

10. A container comprising:

a bottomed tubular container body having a containment space for contents; and the cap according to claim 1 attached to a mouth portion of the container body.

* * * * *